US007847169B2

(12) United States Patent
Umeda

(10) Patent No.: US 7,847,169 B2
(45) Date of Patent: Dec. 7, 2010

(54) STRINGED INSTRUMENT

(76) Inventor: Isao Umeda, 3-67, Kamisabahigashi, Yanaizu-cho, Gifu-shi, Gifu (JP) 501-6121

( * ) Notice: Subject to any disclaimer, the term of this patent is extended or adjusted under 35 U.S.C. 154(b) by 0 days.

(21) Appl. No.: 12/599,439

(22) PCT Filed: Aug. 11, 2008

(86) PCT No.: PCT/JP2008/064408

§ 371 (c)(1),
(2), (4) Date: Nov. 9, 2009

(87) PCT Pub. No.: WO2009/034801

PCT Pub. Date: Mar. 19, 2009

(65) Prior Publication Data

US 2010/0139473 A1 Jun. 10, 2010

(30) Foreign Application Priority Data

Aug. 20, 2007 (JP) ..... 2007-213275

(51) Int. Cl.
*G10D 3/00* (2006.01)

(52) U.S. Cl. ..... 84/267; 84/291

(58) Field of Classification Search ..... 84/267, 84/290, 291

See application file for complete search history.

(56) References Cited

U.S. PATENT DOCUMENTS 4,027,570 A 6/1977 Rendell et al.
5,044,246 A * 9/1991 Schmidt ..... 84/291
5,922,979 A 7/1999 Yui
2004/0060418 A1 4/2004 Taylor

FOREIGN PATENT DOCUMENTS

| | | | |
|---|---|---|---|
| GB | 330427 | A | 6/1930 |
| JP | 47-020818 | Y | 7/1972 |
| JP | 50-65409 | U1 | 6/1975 |
| JP | 2001-134263 | A | 5/2001 |
| JP | 2002-507290 | A | 3/2002 |
| JP | 2006-501519 | A | 1/2006 |
| JP | 3847746 | B2 | 11/2006 |

OTHER PUBLICATIONS

International Search Report of PCT/JP2008/064408, mailing date of Jan. 13, 2009.

* cited by examiner

*Primary Examiner*—Kimberly R Lockett
(74) *Attorney, Agent, or Firm*—Westerman, Hattori, Daniels & Adrian, LLP

(57) ABSTRACT

A guitar includes a brace bar having a longitudinal horizontal coupling portion arranged so as to be parallel along a top plate inner surface of the top plate, a pair of connecting legs bent from both ends of the horizontal coupling portion so as to be orthogonal to the longitudinal direction, and a bridge coupling leg provided along a projecting direction of the connecting leg from vicinity of the center of the horizontal coupling portion is attached to the top plate. A pair of recesses obtained by cutting the top plate into a recess form are formed on the top plate and a connecting leg of the brace bar are connected with vibrating thin plate bonded to the recesses.

8 Claims, 7 Drawing Sheets

STRINGED INSTRUMENT

This application is the national stage of International Application No. PCT/JP2008/064408, filed on Aug. 11, 2008.

BACKGROUND OF THE INVENTION

1. Field of the Invention

The present invention relates to a stringed instrument, particularly to a stringed instrument including a brace bar which is attached to a top plate inner surface of the stringed instrument such as an acoustic guitar, has a function of strengthening and supporting a body of the stringed instrument, and can adjust sounds by vibration of the top plate.

2. Description of Related Art

Conventionally, stringed instruments such as a guitar capable of producing unique tone to each stringed instrument by resonating vibration of tightly stretched strings in a hollow body and vibrating a top plate, are manufactured. Here, a general guitar is explained as an example. The guitar mainly includes a body formed into a hollow state with a top plate, side plates, and a back plate, a neck provided so as to be projected upward from the body, a fingerboard bonded to an upper surface of the neck, abridge provided at a center of a top plate outer surface of the body, a plurality of brace bars provided at a top plate inner surface for strengthening the top plate, a head provided at the distal end of the neck and a plurality of strings (for example, typically six strings in a case of a guitar) tightly stretched between the bridge and the head, as main components.

The plurality of brace bars attached to the top plate inner surface of the body have a function of strengthening the top plate, as described above. It is also known that layout, length, material, shape and the like of the brace bars have a great influence on sound characteristics such as sound intensity, tone, or resonation of the stringed instrument. For this reason, manufacturers of the stringed instrument pay close attention to attachment, layout, and the like of the brace bars.

Each brace bar is typically formed of a bar-shaped member obtained by processing woods, or the like. Such brace bar has at least one flat surface so as to be fixed to the top plate inner surface of the flat top plate in a tightly attached manner. Then, the brace bar is bonded to the top plate by applying adhesive to the above flat surface. The adhesive is typically used for manufacturing the stringed instrument. As a generally known layout of the plurality of brace bars, the brace bars are arranged from the lower side of a sound hole arranged so as to penetrate through the center of the top plate to the bottom edge of the body in a fan-like form. Attempts that each of length, shape, material, and the like of each brace bar is changed between a high-pitched tone region and a low-pitched tone region are made.

In addition, layout of the brace bars is not limited to the above layout in which the plurality of brace bars are simply arranged in a fan-like form, and it is known that long and short brace bars are arranged longitudinally and transversely, respectively, so as to improve sound characteristics (for example, see Patent Document 1). In addition, it is also known that both ends of each brace bar are processed to be tilted from the distal ends to the vicinity of the center, and the tilt angle is adjusted in accordance with arrangement of the top plate.

[Patent Document 1] Japanese Patent No. 3847746

However, the stringed instrument such as the guitar as described above is manufactured by bonding the brace bar to the top plate such that the entire brace bar is closely attached along the top plate inner surface. And the top plate is vibrated averagely over the entire plate. That is to say, there has been no stringed instrument having a configuration in which a specific spot of the top plate is intensively vibrated in the past.

As is well known conventionally, sound generated from one generation source propagates around the generation source as wave motion so as to strongly vibrate a specific spot.

SUMMARY OF THE INVENTION

Technical Problem

Then, the present invention has been made in view of the above circumstances and an object thereof is to provide a stringed instrument capable of improving sound characteristics of the stringed instrument by vibrating a specific spot of the top plate and resonating the entire top plate.

Solution to Problem

In order to achieve the above-described object, according to the present invention, there is provided a stringed instrument "including a body formed into a hollow state, which has a top plate, side plates, a back plate and vibration adjusting means provided on at least one of the top plate and the back plate, wherein the vibration adjusting means includes at least any one of: recess vibration adjusting portions having recesses by forming at least one of a top plate inner surface and a back plate inner surface into a recess form; cone vibration adjusting portions having the recesses and vibrating thin plates which are substantially identical to peripheries of the recesses, and are loosely inserted and bonded to the recesses with predetermined spaces from recess sidewalls; trench vibration adjusting portions having trenches by forming at least one of the top plate inner surface and the back plate inner surface into a looped trench form and raised areas surrounded by the trenches."

In this case, the stringed instrument refers to instruments which generate sounds by using vibration of strings. As examples of the instruments, there are known a rubbed string instrument which vibrates strings by rubbing the strings with a bow or the like, such as a violin, a viola, a cello, and a double bass, a struck string instrument which vibrates strings by striking, such as a piano, and a plucked string instrument which vibrates strings by plucking the strings with fingers or the like, such as a guitar, a mandolin, and a lute. All of them generate a loud sound by resonating vibration of the strings. The invention assumes to be the stringed instrument including a hollow body so that the invention is mainly directed to the rubbed string instrument or the plucked string instrument.

The vibrating thin plate of the cone vibration adjusting portion is obtained by processing woods or the like to thin plate, for example. The vibrating thin plate functions as a vibrating plate capable of propagating sounds by vibration such as a speaker cones used for speakers. In this case, the vibrating thin plate is bonded to the top and/or back plate inner surface with adhesive or the like so that vibration of the vibrating thin plate propagates to the top and/or back plate and the entire the plate vibrates. Further, since vibration of sounds propagates as wave motion, sounds spreads over the top and/or back plate about the vibrating thin plate in a substantially concentric fashion. Here, peripheral shape of the vibrating thin plate is not particularly limited, but the peripheral shapes mainly formed with a curve, such as a circular shape, an elliptic shape, or a pear shape, are suitable in order to adapt to the spreading of sounds and prevent the propagation of sounds from being inhibited. In addition, the material of the vibrating thin plate is not limited to woods as described above, materials other than the woods, such as a metal, a glass, and a paper may be used. When woods are used, quality or hardness of the woods to be used may be appropriately changed to obtain intended sound characteristics. Further, side view shape of the vibrating thin plate is not particularly limited, but the shape may be at least any one of a flat board shape, a cone shape, a semisphere shape, and a wave shape.

On the other hand, the recess is formed by cutting the top and/or back plate into a recess form. Although it is expected that the above vibrating thin plate is simply bonded to the top and/or back plate inner surface, the recess is formed so that the recess sidewall has an inner peripheral shape substantially identical to the outer shape of the vibrating thin plate in order to ensure the propagation of sounds. Further, since the recess is processed to be substantially identical to shape of the vibrating thin plate to be loosely inserted, a predetermined space is kept between the recess sidewall and the outer peripheral wall of the vibrating thin plate in a state that the vibrating thin plate is loosely inserted. The recess vibration adjusting portion is obtained by removing the vibrating thin plate from the above cone vibration adjusting portion and the same effect as described above can be achieved with the recess vibration adjusting portion in some case.

In addition, the trench vibration adjusting portion has a trench obtained by drilling at least one of the top plate inner surface and the back plate inner surface into a trench form, and a raised area surrounded by the trench and having a predetermined shape (for example, elliptic shape). The upper surface of the raised area is identical to the top plate inner surface or the back plate inner surface. That is to say, the raised area is formed to project upward (in the direction of the space inside the body) from the deepest portion of the trench when seen from the side. It is to be noted that the vibrating thin plate of the cone vibration adjusting portion may be bonded to the upper surface of the raised area. Then, the vibrating thin plate and the trench vibration adjusting portion adjust vibrations of the top plate and/or the back plate.

Therefore, according to the stringed instrument of the invention, resonation of the stringed instrument can be kept longer and the sound characteristics can be changed, for example, volume of the generated sound is increased by a following constitution. That is, the top plate inner surface or the back plate inner surface is formed, a recess is formed thereon, then the vibrating thin plate is fitted in a loosely inserted manner and bonded to the recess. Alternatively, a trench and a raised area are formed on the top plate inner surface and the back plate inner surface. It is to be noted that woods different from the top plate, such as a pine, a cedar, and a lauan, may be used for a material used for the vibrating thin plate. The effect of improving the sound characteristics as described above can be also expected by providing the recess on either of the top and/or back plate or the back plate.

In consideration of a general arrangement of the strings of the guitar and the like, it is known that a high-pitched tone region at which a high-pitched sound having a short wavelength is generated is on the observers' left and a low-pitched tone region at which a low-pitched sound having a long wavelength is on the observers' right, when the top plat inner surface is seen from the inner front. A material having small vibration area and/or made of a hard material is selected for the high-pitched tone region so as to resonate at a high frequency and the vibrating thin plate is formed thereon. On the other hand, a material having a relatively large vibration area and/or made of a soft material is selected for the low-pitched tone region so as to resonate at a low frequency and the low-pitched tone region is formed as the vibrating thin plate. Therefore, regardless whether the sound characteristics are adjusted by only the vibrating thin plate, or adjusted by using the brace bar, sound characteristics can be adjusted better. It is to be noted that selection of the size and the material may be performed on the second vibrating thin plate in the same manner.

Further, the stringed instrument according to the invention may have a configuration that "in each cone vibration adjusting portion, a pair of the recesses are provided on the top plate inner surface at positions opposed to the attachment position of a bridge attached to the top plate outer surface so as to sandwich the bridge, and the cone vibration adjusting portions further include brace bars each of which has a pair of connecting legs that are coupled to the vibrating thin plates loosely inserted and bonded to the recesses and a horizontal coupling portion which laterally bridges the connecting legs and couples along the top plate inner surface, and is connected to the top plate inner surface at least two points."

The brace bar has a pair of connecting legs that are coupled to the above vibrating thin plates and a horizontal coupling portion which laterally bridges the connecting legs. That is, the brace bar is not in plane-contact with the top plate inner surface as in the conventional brace bar, but is coupled through the connecting legs (or spots). Woods different from the top plate, such as a pine, a cedar, and a lauan can be used for the brace bar as those in the above vibrating thin plates. In addition, metals such as aluminum and copper, composite materials such as CFRP (carbon fiber reinforced plastic), glasses, or papers can be also used. The connecting legs may be coupled to the vibrating thin plates with common adhesive, for example.

According to the stringed instrument of the invention, sound characteristics of the stringed instrument can be further improved with an effect of the brace bar as well as improvement of sound characteristics with the vibrating thin plates. In addition, the top plate can be supported at least two points with the brace bar, that is, the brace bar also has a function of supporting and strengthening the top plate as in the conventional brace bar.

The stringed instrument according to the invention may further include "through holes which are provided so as to be bored through the top plate at least one of the upper side and lower side of the bridge attached to the top plate outer surface; second vibrating thin plates which are loosely inserted to the through holes or are covered so as to substantially close the through holes; and a brace bar which has connecting legs coupled to the vibrating thin plates that are loosely inserted and bonded to the recesses, second connecting legs coupled to the second vibrating thin plate, and horizontal coupling portions which laterally bridge the connecting legs and the second connecting legs along the top plate inner surface, supports the second vibrating thin plates in a state where the second vibrating thin plates are loosely inserted into the through holes, and is connected to the top plate inner surface at least two points."

Here, since the recess, the second vibrating thin plate, and the brace bar have substantially same configurations as those described above, description thereof is not repeated. The through hole is provided so as to penetrate through the top plate inner surface and the top plate outer surface. In a case of a general guitar, a sound hole which is a circular hole is provided substantially in the vicinity of the center of the top plate for radiating sounds resonated inside the body. The through hole having a smaller diameter than the sound hole, for example, is provided at upper side or lower side of the bridge and has a function as so-called "auxiliary sound hole".

In this case, the second vibrating thin plate is loosely inserted to the through hole and is supported by the connecting leg so that a predetermined space is kept so as not to be in contact with the through hole wall of the through hole. That is to say, the second vibrating thin plate can vibrate freely in accordance with the vibration of the strings in a state that the second vibrating thin plate is loosely inserted to the through hole, while covering the through hole. As a result, characteristics of the generated sound can be adjusted.

According to the stringed instrument of the invention, a plurality of the through holes serving as auxiliary sound holes are provided, and the second vibrating thin plate is loosely inserted to and supported by each of the through holes. Therefore, sound is generated outside by directly vibrating a second vibration plate through the brace bar. This makes possible to generate complex sounds which cannot be generated with a conventional brace bar. Here, all of the through holes need not necessarily penetrate thorough the top plate and it is sufficient that holes are provided on apart of the top plate in a slit form or a grid form for easily radiating sounds from the second vibrating thin plate.

Further, the stringed instrument according to the invention may have a configuration that "the brace bar further includes abridge coupling leg which is provided vertically from the horizontal coupling portion, and connected to the top plate inner surface at a position opposed to the attachment position of the bridge attached to the top plate outer surface."

According to the stringed instrument of the invention, the brace bar is supported to the top plate inner surface at at least three points with a pair of the connecting legs and the bridge coupling leg, or at least two points of a connecting leg and the bridge coupling leg. Therefore, the brace bar is stably attached to the top plate. Further, since the bridge coupling leg is provided so as to be opposed to the attachment position of the bridge, the vibration of the strings propagates to the top plate through the bridge and the vibration of the top plate propagates to the brace bar through the bridge coupling leg. This makes possible to change the sound characteristics of the stringed instrument to be much better.

Here, the shape of the brace bar is not particularly limited, but the brace bar can be formed by crossing the horizontal coupling portion into an X-shape, a V-shape, or a combination shape thereof. With theses shapes, a pair (two) of the horizontal coupling portions are formed into an X-shape, a V-shape, or a combination shape thereof so that the brace bar is formed by crossing the horizontal coupling portions to each other at least one point. Therefore, the top plate is supported at least three points so that the characteristics of generated sounds by the stringed instrument can be adjusted more delicately in addition to the above effect. Here, the shape of the brace bar is exemplified. For example, an X-shape obtained by crossing the horizontal coupling portions in the vicinity of the bridge, a V-shape obtained by bending the horizontal coupling portion in the vicinity of the bridge, or a asterisk-shape obtained by combining three horizontal coupling portions and crossing them in the vicinity of center can be made.

On the other hand, the stringed instrument according to the invention may further include "a brace bar which has a bar base provided on the top plate inner surface at a position opposed to the bridge and a long bar vibrating portion extended in the direction orthogonal to the longitudinal direction of the bridge from the bar base, the brace bar being formed into a T-shape or an L-shape, and sound posts which are arranged vertically from distal ends of the long bar vibrating portion, and distal ends of which are abutted against one of the vibrating thin plates of the cone vibration adjusting portions and the raised areas of the trench vibration adjusting portions provided on the back plate inner surface."

Therefore, the stringed instrument of the invention has a brace bar which is attached to the top plate inner surface and is formed into a T-shape or an L-shape, and sound posts connecting the vibration portion of the brace bar and the back plate inner surface. In this state, when strings of the stringed instrument are plucked, the top plate vibrates through the bridge and air inside the body vibrates. Further, the brace bar and sound posts attached to the top plate inner surface are provided so that they bridge between the top plate and the back plate. Sound post distal ends are abutted against the back plate inner surface. Therefore, vibration of the strings can propagate through the brace bar and sound posts. In particular, since sound posts are attached to the brace bar having a long bar vibration portion arranged to be orthogonal to the bridge, vibration can propagate to the back plate, which is lower side of the bridge, through the bridge. As a result, sound characteristics of the stringed instrument can be improved. It is to be noted that the sound posts and the brace bar may be made of various materials such as woods, metals, plastic resins, and the like as described above. In addition, sound post distal ends and the back plate inner surface need not be strongly fixed by fixing means such as adhesive, and sound post distal ends may be sandwiched between the brace bar and the back plate. The shape of the brace bar may be a T-shape formed by extending vibration portion to both directions along a longitudinal direction of the stringed instrument by setting a position of the top plate inner surface opposed to the bridge as a center, or may be an L-shape formed by extending the vibration portion to one direction from a position of the top plate inner surface opposed to the bridge. In addition, length from an attachment position of the bar base to the distal ends of the vibration portion may be different from each other even in the T-shape. Sound characteristics of the stringed instrument can be adjusted by changing the settings.

On the other hand, a stringed instrument according to the invention may further include "a body formed into a hollow state, which has a top plate, side plates, a back plate and vibration adjusting means provided on at least one of the top plate and the back plate, wherein the vibration adjusting means of the body includes an internal vibration plate which is arranged along the longitudinal direction of a bridge attached to a top plate outer surface at a position of a top plate inner surface so as to be opposed to the bridge, bridges side plate inner surfaces of a pair of the side plates opposed to each other, and divides a hollow space inside the body into at least two parts."

According to the stringed instrument of the invention, a hollow space inside the body is divided into at least two spaces by the internal vibration plate. This makes possible to improve sound characteristics by adjusting vibrations of the top plate and the back plate and sounds resonating in the hollow spaces. At this time, the plate surface of the internal vibration plate can be orthogonal to or tilted at a predetermined angle to the top plate inner surface, and sound characteristics can be improved by these adjustments. The internal vibration plate is composed of one plate and couples to the side plates. Therefore the internal vibration plate may completely block the hollow spaces divided into at least two spaces or may communicate divided spaces with each other by making holes at apart of the plate (for example, in the vicinity of connecting points with side plates). The internal vibration plate may be fixed to the body by using a pair of stopper claws which are provided at the side plate inner surfaces, respectively, and are spaced at a distance substantially equal to the width of the internal vibration plate, and inserting the internal vibration plate between the stopper claws. Further one side (bottom side and upper side) of the internal vibration plate need not be in contact with the top plate inner surface and the back plate inner surface and a space having a predetermined distance may be provided therebetween. Operational effect by the internal vibration plate according to the invention is the substantially same effect as in the configuration of the vibrating thin plates in the above stringed instrument. That is to say, in the case of the vibrating thin plates, vibration of the top plate can propagate by being contact with the top plate along the top plate inner surface. On the other hand, while the internal vibration plate is provided so as to be orthogonal to the top plate inner surface, the internal vibration plate also vibrates similarly by the vibration of the top plate. With this configuration, sounds generated by the stringed instrument can be increased. Therefore, it is recognized that both configurations sufficiently have unity of the invention.

Further, the stringed instrument according to the invention may have a configuration that "the hollow space has: a first resonation space which is positioned at an upper portion of the bridge, and communicates with the outside through a sound hole bored through the top plate; and a second resonation space which is positioned at a lower portion of the bridge, and is divided from the first resonation space by the internal vibration plate, and the top plate has a second sound hole which is bored through the plate and communicates with the second resonation space."

According to the stringed instrument of the invention, a second sound hole communicating with the second resonating space is provided at a part of the divided hollow space. Generally, in the stringed instruments such as a guitar, the sound hole is provided at one position which is substantially in the vicinity of the center of the top plate and at the upper portion of the bridge. However, when the hollow space is divided into two spaces of upper portion and lower portion by setting the bridge as a boundary, for example, one space communicates with the sound hole and resonated sounds in the hollow space are diffused and radiated outside from the sound hole. On the other hand, in the other space (space without a sound hole), sounds are not sufficiently diffused and radiated so that improvement of sound characteristics is inhibited because sounds are covered or become hollowly, for example. Then, the above problem can be solved by providing a second sound hole so that divided spaces (first resonation space and second resonation space) communicate with sound holes.

The stringed instrument according to the invention may include "a supporting portion which is attached to the top plate inner surface in the vicinity of the internal vibration plate, and a vibration bar which is arranged vertically from the supporting portion and connected to apart of the plate surface of the internal vibration plate at the distal ends of the bar."

According to the stringed instrument of the invention, the internal vibration plate, the supporting portion provided on the top plate inner surface, and the vibration bar are connected to each other. This makes possible to improve sound characteristics by resonating the vibration of the internal vibration plate and the vibration propagated through the vibration bar from the top plate.

As an effect of the invention, sound characteristics of a stringed instrument can be improved by providing recesses formed by cutting inner surfaces of the top plate or the back plate into a recess form, cutting the vibrating thin plates into predetermined shapes, and bonding the vibrating thin plates to the recesses. Therefore, the stringed instrument having better sound characteristics, by which volume is increased and resonation lasts longer, can be obtained. Further, sound characteristics can be improved by arranging various components such as the sound posts, the brace bar having a T-shape or the like, the internal vibration plate, and the vibration bar in contact with the internal vibration plate in the hollow space and changing the sound vibration in the hollow space.

BRIEF DESCRIPTION OF THE DRAWINGS

FIG. 8(A) is an illustration showing an internal configuration, FIG. 8(B) is a cross-sectional view cut along a line VIIIB-VIIIB, and FIG. 8(C) is a perspective view showing a configuration of the brace bar.

FIG. 9(A) is an illustration showing an internal configuration seen from the front, FIG. 9(B) is a perspective view showing an abutment state of an internal vibration plate and a vibration bar.

DETAILED DESCRIPTION OF THE INVENTION

Figure 1:
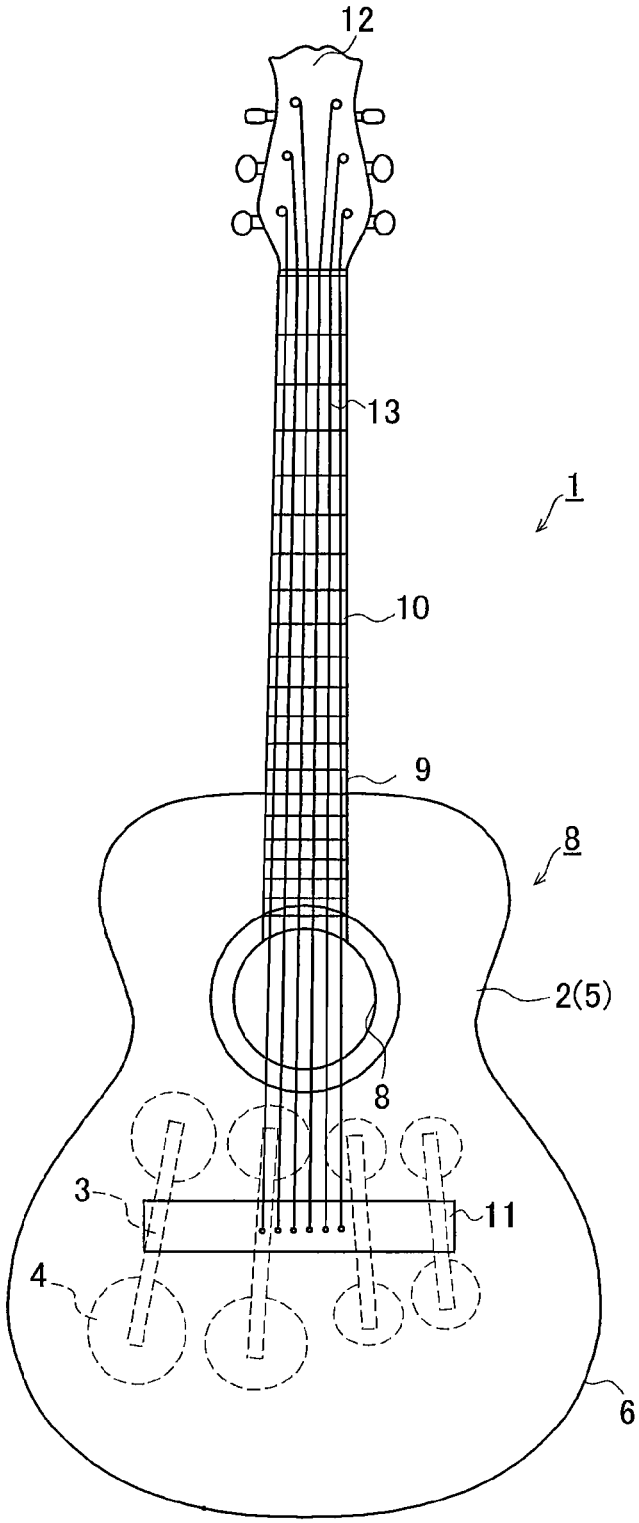
FIG. 1 is an illustration showing a schematic configuration of a guitar according to a first embodiment.
Figure 2:
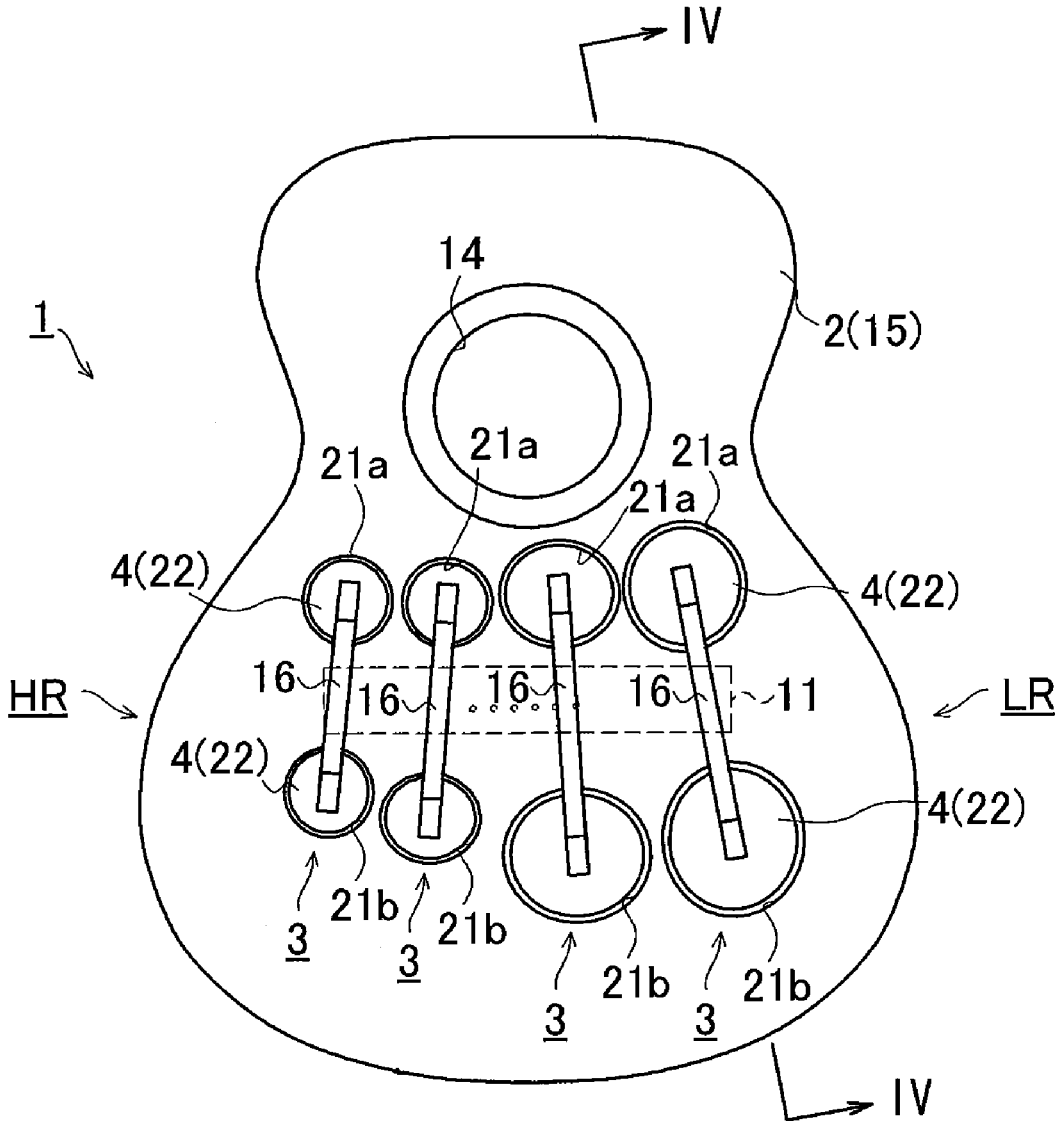
FIG. 2 is an illustration showing a configuration of a top plate and a layout of brace bars of the guitar.
Figure 3:
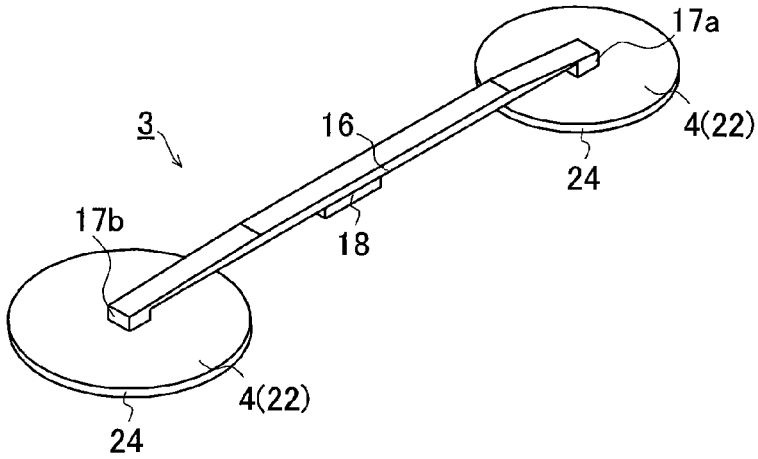
FIG. 3 is an illustration showing configurations of the brace bar and vibrating thin plates.
Figure 4:
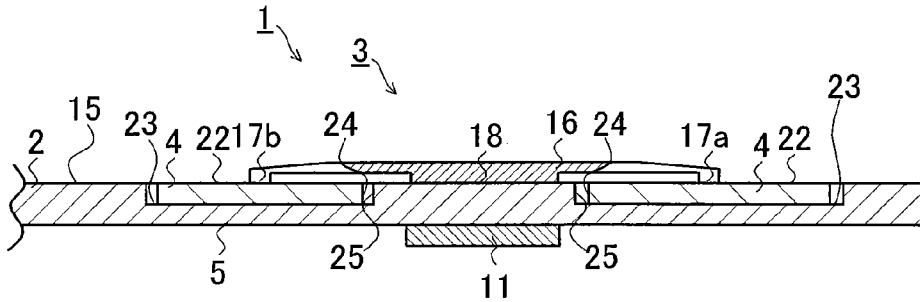
FIG. 4 is a schematic cross-sectional view cut along a line IV-IV showing a configuration of the top plate having the brace bar attached.

Hereinafter, a guitar 1 according to a first embodiment of the invention is described with reference to FIG. 1 to FIG. 4. FIG. 1 is an illustration showing a schematic configuration of the guitar 1 according to the first embodiment, FIG. 2 is an illustration showing a configuration of a top plate 2 and a layout of brace bars 3 of the guitar 1, FIG. 3 is an illustration showing configurations of the brace bar 3 and vibrating thin plates 4 (hereinafter, referred to as "vibrating plates 4"), and FIG. 4 is a schematic cross-sectional view cut along aline IV-IV showing a configuration of the top plate 2 having the brace bar 3 attached. Here, the guitar 1 corresponds to a stringed instrument of the invention. It is to be noted that the guitar 1 shown in the embodiment is explained by illustrating a general acoustic guitar as an example.

As shown in FIG. 1 to FIG. 4, the guitar 1 of the embodiment includes a body 8 formed into a hollow state with the top plate 2, side plates 6, and a back plate (not shown), a neck 9 provided so as to project upward from the body 8, a fingerboard 10 bonded to an upper surface of the neck 9, a bridge 11 provided in the vicinity of the center of a top plate outer surface 5 of the body 8, a head 12 provided at the distal end of the neck 9 and strings 13 tightly stretched between the bridge 11 and the head 12, as main components. Here, main constituent members of the guitar 1 such as the body 8 are formed by processing woods as in general acoustic guitars. Metals and the like are used for a partial configuration such as the strings 13.

Further, when the top plate 2 of the guitar 1 is observed from the inner side of the body 8, a circular sound hole 14 is provided in the vicinity of the center of the top plate 2 so as to penetrate through the top plate and a plurality of brace bars 3 formed in a substantially E-shape are attached on the lower side of the sound hole 14, as shown in FIG. 2. As attachment of the brace bars 3 is described in more detail, the plurality of brace bars 3 are formed in a substantially E-shape when seen from the side by processing woods (see FIG. 4). Each of the brace bars 3 includes a longitudinal horizontal coupling portion 16 arranged so as to be parallel along a top plate inner surface 15 of the top plate 2, a pair of connecting legs 17*a*, 17*b* bent from both ends of the horizontal coupling portion 16, respectively, so as to be orthogonal to the longitudinal direction, and a bridge coupling leg 18 provided along a projecting direction of the connecting leg 17*a*, 17*b* from the vicinity of the center of the horizontal coupling portion 16. Meanwhile, in the guitar 1 of the embodiment, four brace bars 3 are attached to the top plate inner surface 15, relatively short brace bars 3 in the longitudinal direction are used in a high-pitched tone region HR of the top plate inner surface 15 and brace bars 3 longer than those in the high-pitched tone region HR are used in a low-pitched tone region LR.

Each vibrating plate 4 having a substantially elliptic cross-section, which is obtained by processing woods to a thin plate, is bonded to each of the connecting legs 17*a*, 17*b* of the brace bar 3 with adhesive. Here, the size of each vibrating plate 4 is as follows. While the vibrating plates 4 having relatively small vibrating area are used for the brace bars 3 attached in the above high-pitched tone region HR, the cone potions 4 having relatively large vibrating area are used for the brace bars 3 attached in the low-pitched tone region LR.

On the other hand, the top plate 2 to which the brace bar 3 having the vibrating plates 4 attached is configured as follows. That is, the top plate inner surface 15 has four pairs of recesses 21*a*, 21*b* which are formed so as to be substantially identical to the peripheries of the above vibrating plates 4 and are provided at positions opposed to each other so as to sandwich the bridge 11 attached to the top plate outer surface 5. Here, the recess 21*a*, 21*b* is formed to be slightly larger than the periphery of the vibrating plate 4. Therefore, when one vibrating surface 22 of each of the vibrating plate 4 is loosely inserted and bonded to a bottom 23 of the recess 21*a*, 21*b*, a space having a predetermined distance is formed between the peripheral surface 24 of the vibrating plate 4 and a recess sidewall 25 of the recess 21*a*, 21*b*. Although after the brace bar 3 is previously bonded to the vibrating plate 4, the resultant is bonded to the recess 21*a*, 21*b* of the top plate inner surface 15 in the above description, the invention is not limited thereto. As a matter of course, after the recess 21*a*, 21*b* is previously bonded to the vibrating plate 4, the vibrating plate 4 may be bonded to the connecting leg 17*a* or the like of the brace bar 3. Here, the vibrating plates 4 and the recesses 21*a*, 21*b* correspond to a cone vibration adjusting portion (vibration adjusting means) of the invention.

That is to say, as shown in FIG. 4, the top plate 2 is supported at three points by the brace bar 3 and the vibrating plate 4 coupled to the connecting legs 17*a*, 17*b* of the brace bar 3 at both ends are bonded to the recesses 21*a*, 21*b*, respectively, in the state where the space having a predetermined distance is kept. Meanwhile, the bridge coupling leg 18 extended from the vicinity of the center of the horizontal coupling portion 16 of the brace bar 3 is directly bonded to the top plate inner surface 15 of the top plate 2 with adhesive. The bridge coupling leg 18 is bonded to the top plate inner surface 15 at a bonding position where the bridge 11 is attached to the opposed top plate outer surface 5 of the top plate 2 and the vibration generated by plucking the strings 13 propagates to the top plate 2 from the bridge 11 most directly.

With the above configuration, in the guitar 1 according to the first embodiment, vibration generated by plucking the strings 13 propagates to the entire brace bar 3 through the top plate 2 and the bridge coupling leg 18 via the bridge 11, and propagates to the vibrating plates 4, the recesses 21*a*, 21*b* through the connecting legs 17*a*, 17*b* of the brace bar 3, and further to the top plate 2. Therefore, sound is generated as follows. That is, vibration generated by plucking the strings 13 propagates to the inside of the body 8 by vibrating the vibrating plates 4 of the top plate 2 through the brace bar 3, then sound is generated. It is to be noted that, for example, a trench vibration adjusting portion may be used as vibration adjusting means in place of the cone vibration adjusting portion (vibration adjusting means) composed of the vibrating plate 4, and the recess 21*a*, 21*b*. The trench vibration adjusting portion includes a trench having a predetermined width at the top plate inner surface 15 and a raised area surrounded by the trench, by coupling edges of the trench to each other, for example. With the trench vibration adjusting portion, operation effect such as increase of the sound volume, which is equivalent to that with the above cone vibration adjusting portion, can be achieved. Further, a thin plate member similar to the above vibrating plate 4 may be bonded to the top surface of the raised area.

Figure 5:
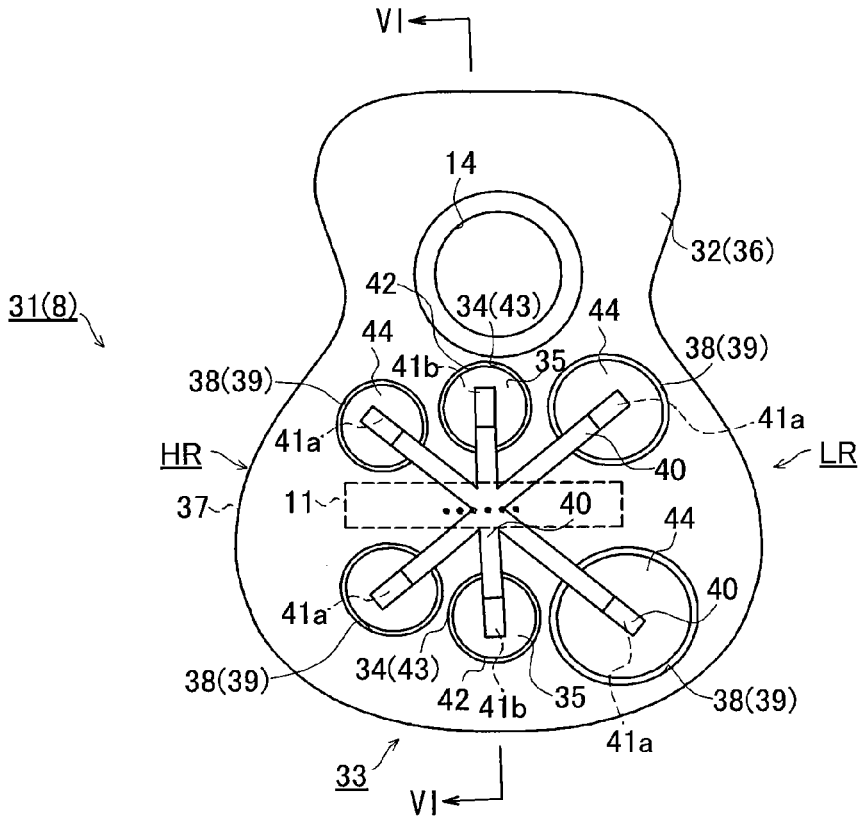
FIG. 5 is an illustration showing a configuration of a top plate and a layout of brace bars of a guitar according to a second embodiment.
Figure 6:
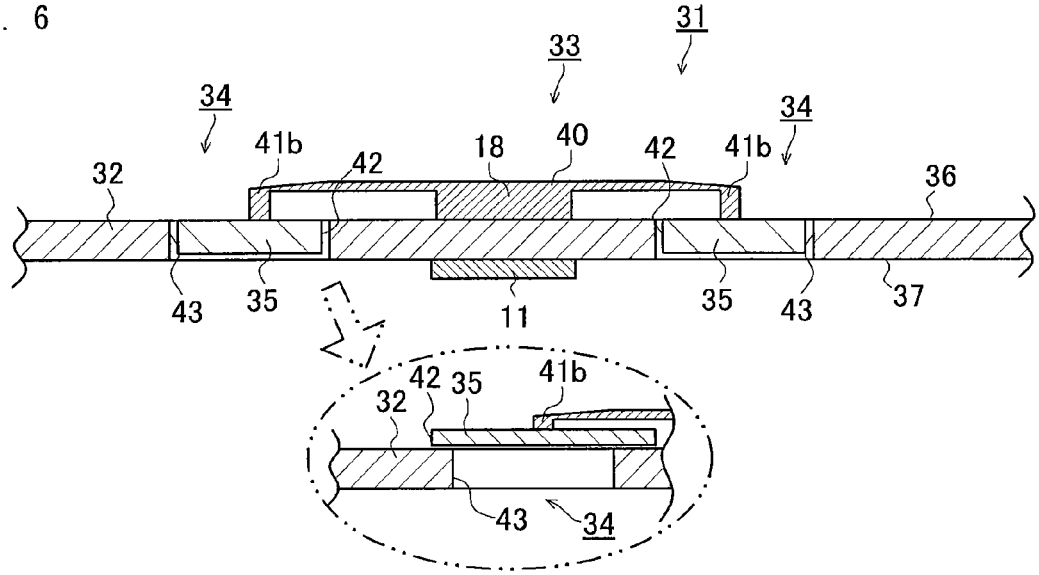
FIG. 6 is a schematic cross-sectional view cut along a line VI-VI showing a configuration of the top plate having the brace bar attached.

Next, a guitar 31 according to a second embodiment of the invention is described with reference to FIG. 5 and FIG. 6. Here, FIG. 5 is an illustration showing a configuration of a top plate 32 and a layout of a brace bar 33 of the guitar 31 according to the second embodiment, and FIG. 6 is a schematic cross-sectional view cut along a line VI-VI showing a configuration of the top plate 32 having the brace bar 33 attached. Since appearance configuration of the guitar 31 of the second embodiment is substantially same as that of the guitar 1 of the first embodiment (see FIG. 1), detail description thereof is not repeated here. The guitar 31 of the second embodiment is different from the guitar 1 of the first embodiment in that the guitar 31 includes through holes 34 functioning as auxiliary sound holes and provided at the top plate 32, second vibrating plates 35 (corresponding to the second vibrating thin plates) which are loosely inserted to and supported by the through holes 34 and the brace bar 33 in an asterisk-shape. Hereinafter, these different points are described in detail.

As shown in FIG. 5 and FIG. 6, in the guitar 31 of the second embodiment, two through holes 34 smaller than the sound hole 14 are provided at positions which are lower side of the circular sound hole 14 provided in the vicinity of the center of the top plate 32 of the guitar 31 and are further upper side and lower side of the bridge 11 attached to a top plate outer surface 37. The two through holes 34 are provided so as to be bored through a top plate inner surface 36 and the top plate outer surface 37, respectively. Meanwhile, two recesses 38 formed by cutting processing as in the top plate 2 of the guitar 1 of the first embodiment are provided on the top plate inner surface 36 at upper side and lower side of the bridge 11, respectively. That is to say, two recesses 38 and one through hole 34 are provided to be paired.

Here, the vibrating plates 44 are formed into a substantially same shape as the recesses 38 as described in the guitar 1 of the first embodiment. Moreover, each vibrating plate 44 can be bonded to each recess 38 with a space having a predetermined distance between the vibrating plate 44 and the recess sidewall 39 of the recess 38 by loosely inserting the vibrating plate 44 to the recess 38.

Further, as shown in FIG. 5, the brace bar 33 is configured such that three horizontal coupling portions 40 are crossed to each other into an asterisk-shape, and pairs of connecting legs 41*a*, 41*a* (or 41*b*, 41*b*) bent from both ends of each horizontal coupling portion 40, are provided so as to be orthogonal to the longitudinal direction of the horizontal coupling portion 40. In addition, a bridge coupling leg 18 projecting toward the top plate inner surface 36 along the connecting legs 41*a* or the like is formed at a position where the horizontal coupling portions 40 are crossed. Here, vibrating plates 44 are attached to the connecting legs 41*a*, in other words, the connecting legs 41*a* coupled to the recesses 38 at the distal ends thereof as in the guitar 1 of the first embodiment. Moreover, the vibrating plates 44 are bonded to the recesses 38. On the other hand, the second vibrating thin plates 35 (second vibrating plates 35) are attached to the connecting legs 41*b*, the second vibrating plates 35 are loosely inserted to and supported by the through holes 34 bored through the top plate 32. In this case, as shown in FIG. 6, predetermined spaces are formed between peripheral surfaces 42 of the second vibrating plates 35 and through hole wall portions 43 of the through holes 34. That is, the second vibrating plates 35 are supported by only connecting legs 41*b* in a state where the second vibrating plates 35 are inserted to the through holes 34 and not in contact with the peripheries.

Here, as shown in FIG. 5 and FIG. 6, the second vibrating plate 35 inserted to the through hole 34 is to be thin plate. However, the shape is not limited thereto, and sound and echo of the top plate 32 can be appropriately adjusted by forming the second vibrating plate 35 into a semisphere shapes, for example.

With the above configuration, the guitar 31 of the second embodiment has a plurality of through holes 34 functioning as the sound holes on the top plate 32, and can improve sound characteristics by the brace bar 33 attached to the top plate inner surface 36.

Figure 7:
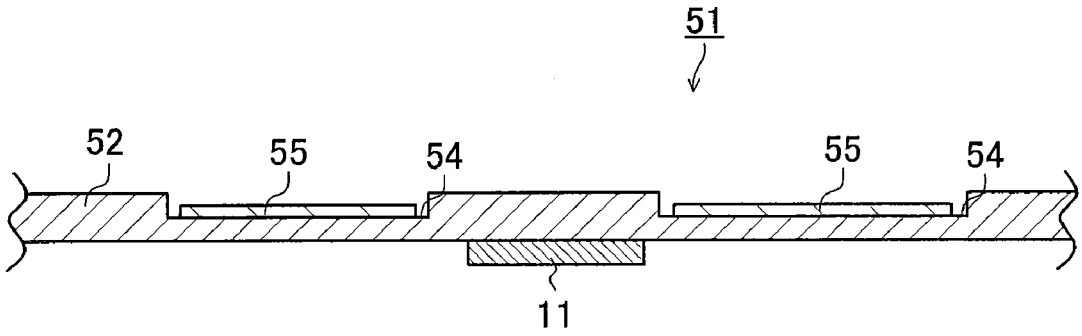
FIG. 7 is a cross-sectional view showing a configuration of a top plate of a guitar according to a third embodiment.

Next, a guitar 51 according to a third embodiment of the invention is described with reference to FIG. 7. FIG. 7 is a cross-sectional view showing a configuration of a top plate 52 of the guitar 51 according to the third embodiment. The guitar 51 of the third embodiment includes recesses 54 formed by cutting processing on a top plate inner surface 53 of the top plate 52, and vibrating plates 55 loosely inserted and bonded to the recesses 54. That is to say, the guitar 51 is configured such that the brace bars 3 in the guitar 1 of the first embodiment described above are eliminated.

With the above configuration, vibration of the top plate 52 can be also adjusted. When the vibrating plates 55 are directly attached to the top plate 52 without forming the recesses 54, vibration of the top plate 52 is suppressed by the vibrating plates 55 as a result, malfunctions that volume is decreased, or the like, may be occurred. Therefore, sound characteristics can be improved by making the vibrating plates 55 thin as possible, preventing vibration of the top plate 52 from being inhibited, and forming the recesses 54 deeply. Further, even though the recesses 54 and the vibrating plates 55 are provided on a back plate (not shown), sound characteristics are expected to be improved similarly.

Figure 8A:
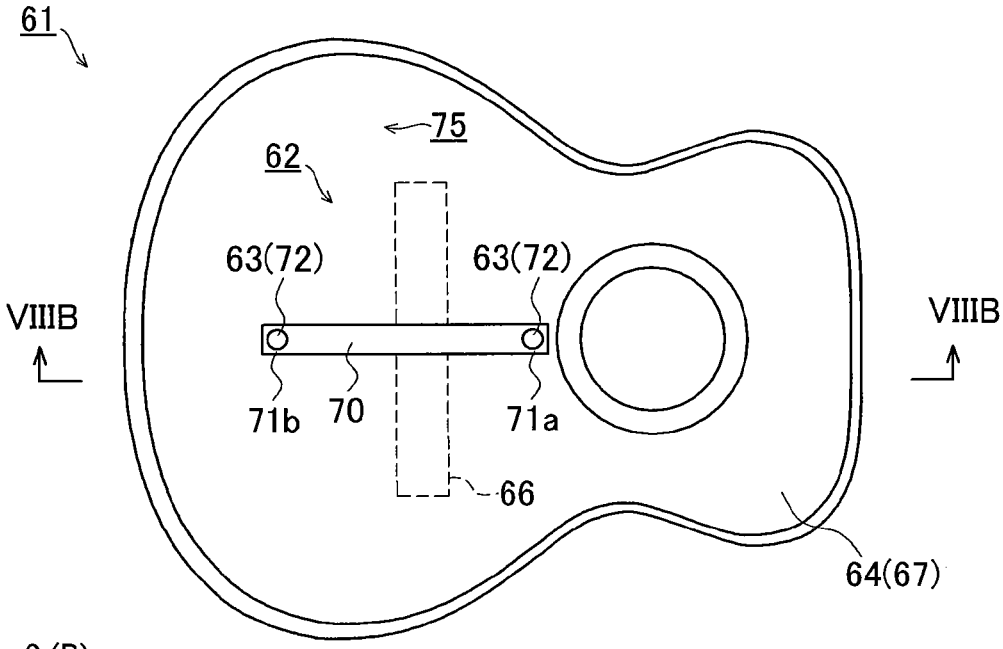
FIG. 8(A)-8(C) show configurations of a brace bar and sound posts of a guitar according to a fourth embodiment.
Figure 8B:
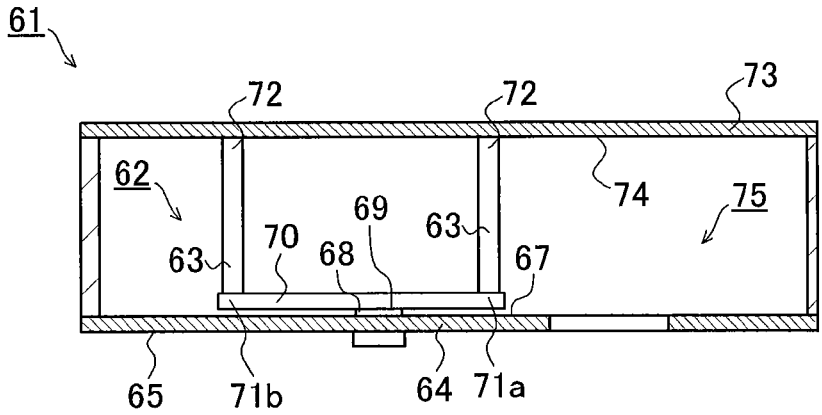
Figure 8C:
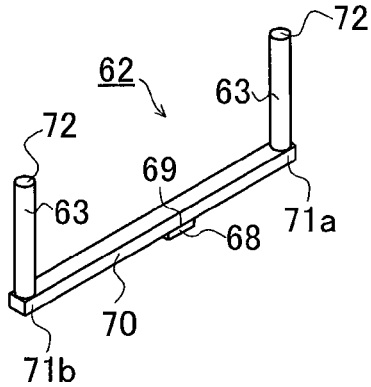

Next, a guitar according to a fourth embodiment of the invention is described with reference to FIG. 8(A)-8(C). FIG. 8(A)-8(C) show configurations of a brace bar 62 and sound posts 63 of a guitar 61 according to the fourth embodiment, FIG. 8(A) is an illustration showing an internal configuration, FIG. 8(B) is a cross-sectional view cut along a line VIIIB-VIIIB, and FIG. 8(C) is a perspective view showing a configuration of the brace bar 62. The basic configuration of the guitar 61 is substantially same as the guitar 1 of the above first embodiment and only different configurations are described here in order to simplify description.

As shown in FIG. 8(A)-8(C), the guitar 61 of the fourth embodiment has a bar base 68 provided on a top plate inner surface 67 at a position opposed to a bridge 66 provided on a top plate outer surface 65 of a top plate 64, a long bar vibrating portion 70 (see FIGS. 8(A) and 8(C)) which is extended in the direction orthogonal to the longitudinal direction of the bridge 66, the brace bar 62 (see FIGS. 8(B) and 8(C)) formed into a T-shape seen from the side, sound posts 63 which are arranged vertically from distal ends 71*a*, 71*b* of the long bar vibrating portion 70, and connected to a part of a cone vibration adjusting portions (not shown) at which distal ends 72 of the sound posts are attached to a back plate inner surface 74 of a back plate 73. The cone vibration adjusting portions have the same operation effect as those in the guitar 1 of the first embodiment described above. Therefore, explanation of the cone vibration adjusting portion is not described and not shown in FIG. 8(A)-8(C) in order to simplify description. For this reason, the sound post distal ends 72 are directly in contact with the back plate inner surface 74 in FIG. 8(A)-8(C). It is noted that the cone vibration adjusting portions may be trench vibration adjusting portions as in the guitar 1 of the first embodiment.

That is to say, the brace bar 62 and the sound posts 63 are arranged between the top plate 64 and the back plate 73 of the guitar 61. In this case, the sound post distal ends 72 need not be fixed by fixing means such as adhesive as long as the sound post distal ends 72 of the sound posts 63 are in contact with a part of the cone vibration portions attached to the back plate inner surface 74.

With the above configuration, vibration of the top plate 64 and the back plate 73 can be adjusted. That is to say, if the strings are plucked in the corresponding configuration, vibration propagates to the top plate 64 through the bridge 66, and the air in a hollow space 75 inside the body vibrates. Further vibration propagates to the back plate 73 through the brace bar 62 and the sound posts 63. At this time, since the guitar 61 of the invention has the brace bar 62 and the sound posts 63 which couple the top plate 64 and the back plate 73, vibration also propagates to the back plate 73 through the brace bar 62 and the sound posts 63. Specifically, vibration of the strings propagates to above and under the guitar 61 across the bridge 66 because the long bar vibrating portion 70 of the brace bar 62 is orthogonal to the bridge 66 and a pair of the sound posts 63 are provided from the ends 71*a*, 71*b* so as to be in contact with the back plate inner surface 74. Therefore, volume is expected to be larger.

Figure 9A:
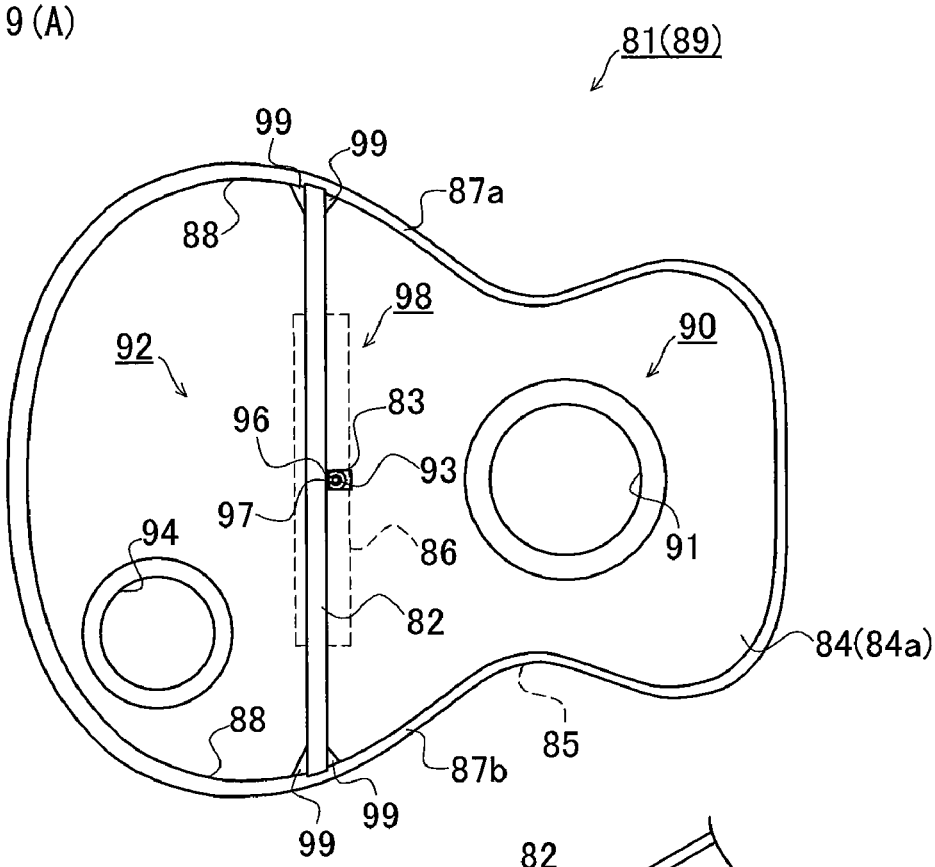
FIG. 9(A), 9(B) show configurations of a guitar according to a fifth embodiment.
Figure 9B:
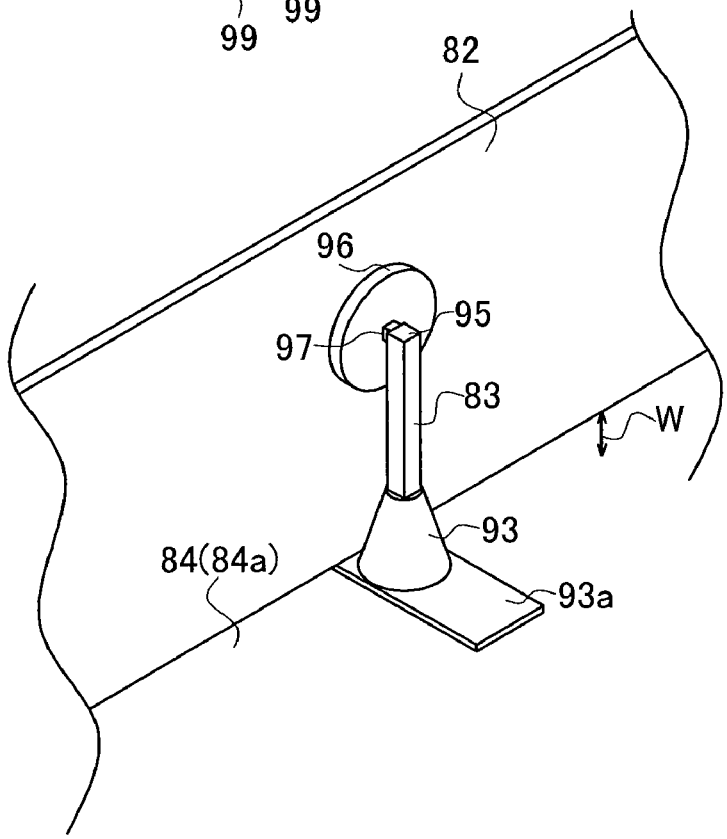

Next, a guitar according to a fifth embodiment of the invention is described with reference to FIG. 9(A), 9(B). FIG. 9(A), 9(B) show configurations of a guitar 81 according to the fifth embodiment, FIG. 9(A) is an illustration showing an internal configuration seen from the front, FIG. 9(B) is a perspective view showing an abutment state of an internal vibration plate 82 and a vibration bar 83. Meanwhile, the basic configuration of the guitar 81 is substantially same as the guitar 1 according to the above first embodiment and only different configurations are described here in order to simplify description.

As shown in FIG. 9(A), 9(B), the guitar 81 of the fifth embodiment includes an internal vibration plate 82, a second sound hole 94, a trapezoidal supporting portion 93 and a substantially bar-shaped vibration bar 83 as main components. The internal vibration plate 82 is arranged along the longitudinal direction of a bridge 86 attached to a top plate outer surface 85 of a top plate 84, is attached orthogonal to a top plate inner surface 84*a* of the top plate 84 such that the internal vibration plate 82 bridges side plate inner surfaces 88 of the side plates 87*a*, 87*b* opposed to each other, and divides a hollow space 90 inside a body 89 into two of an upper side and a lower side. The second sound hole 94 is arranged by making a hole at a lower side of the sound hole 91 provided substantially in the vicinity of the center of the top plate 84, and communicates with a second resonation space 92 (to be described below in detail). The supporting portion 93 is attached to the top plate inner surface 84*a* through an attachment plate 93*a*. The vibration bar 83 is arranged vertically from top of the supporting portion 93 and connected to a circular connecting portion 96 by which the bar distal end 95 is attached to the internal vibration plate 82. Meanwhile, the internal vibration plate 82 is attached to the guitar 81 by inserting the internal vibration plate 82 between a pair of stopper claws 99 provided on the side plate inner surfaces 88. In this case, one side (bottom side) of the internal vibration plate 82 is not in contact with the top plate inner surface 84*a*, and a space W having a predetermined distance is formed.

Here, the hollow space 90 divided by the internal vibration plate 82 is composed of a first resonation space 98 which corresponds to an upper portion of the guitar 81 by setting the internal vibration plate 82 as a boundary and communicates with the sound hole 91, and the second resonation space 92 which corresponds to a lower portion of the guitar 81 and communicates with the second sound hole 94 bored through the top plate 84. In addition, holes (not shown) are provided in the vicinity of connecting points of the inner vibration plate 82 to the inner surfaces 88, and communicates the first resonation space 98 and the second resonation space 92.

Further, vibration of the internal vibration plate 82 can be limited moderately by making the vibration bar 83 vertically arranged to the supporting portion 93 partially contact with the connecting portion 96 of the internal vibration plate 82. Therefore, volume is expected to be larger. Meanwhile, a connection transmitting portion 97 formed of hard woods for surely transmitting vibration is provided between the bar distal end 95 of the vibration bar 83 and the circular connecting portion 96 of the internal vibration plate 82.

With the above configuration, the hollow space 90 can be divided into two spaces 92, 98 by the internal vibration plate 82 to make resonation of the sounds inside the body better. Further, volume can be much larger by vibration of the internal vibration plate 82 itself. As described above, the internal vibration plate 82 is fixed to the hollow space 90 by the side plate inner surfaces 88 and a pair of stopper claws 99 and is not in contact with the top plate inner surface 86 of the top plate 84. Therefore, vibration of the top plate 84 is not inhibited. As a result, sound characteristics can be improved.

The present invention has been described by exemplifying preferred embodiments. However, the invention is not limited these embodiments and various modifications and changes in design can be made without departing from the scope of the invention.

Namely, although circular vibrating plates 4 are used in the first to third embodiments, the invention is not limited thereto. And various shapes of vibrating plates 4 such as a conical, a semisphere, and a waveform can be used. Therefore, sound characteristics to be adjusted can be delicately changed so that resonation and the like of the sound generated by a stringed instrument such as the guitar 1 can be resonant.

In addition, although T-shaped brace bar is used in the forth embodiment, the invention is not limited thereto. And an L-shaped brace bar may be formed and one sound post 63 may be abutted against the back plate inner surface 74. With this configuration, vibration propagated to the back plate inner surface 74 can be adjusted.

Further, although the hollow space 90 is divided into two spaces 92, 98 by the internal vibration plate 82 in the fifth embodiment, the invention is not limited thereto. The hollow space 90 may be divided into two or more spaces. It is expected that position, size and the like of the corresponding spaces have great influence on vibration of sound resonating inside the body so that sound characteristics can be improved by adjusting position, size and the like.

The invention claimed is:

1. A stringed instrument comprising, a body formed into a hollow state, which has a top plate, side plates, a back plate and vibration adjusting means provided on at least one of the top plate and the back plate, wherein the vibration adjusting means comprises at least any one of:

recess vibration adjusting portions having recesses by forming at least one of a top plate inner surface and a back plate inner surface into a recess form;

cone vibration adjusting portions having the recesses and vibrating thin plates which are substantially identical to peripheries of the recesses, and are loosely inserted and bonded to the recesses with predetermined spaces from recess sidewalls;

trench vibration adjusting portions having trenches by forming at least one of the top plate inner surface and the back plate inner surface into a looped trench form and raised areas surrounded by the trenches.

2. The stringed instrument according to claim 1, wherein in each cone vibration adjusting portion, a pair of the recesses are provided on the top plate inner surface at positions opposed to the attachment position of a bridge attached to the top plate outer surface so as to sandwich the bridge, and the cone vibration adjusting portions further comprise brace bars each of which has a pair of connecting legs that are coupled to the vibrating thin plates loosely inserted and bonded to the recesses and a horizontal coupling portion which laterally bridges the connecting legs and couples along the top plate inner surface, and is connected to the top plate inner surface at least two points.

3. The stringed instrument according to claim 1, further comprising:

through holes which are provided so as to be bored through the top plate at at least one of the upper side and lower side of the bridge attached to the top plate outer surface;

second vibrating thin plates which are loosely inserted to the through holes or are covered so as to substantially close the through holes; and a brace bar which has connecting legs coupled to the vibrating thin plates that are loosely inserted and bonded to the recesses, second connecting legs coupled to the second vibrating thin plate, and horizontal coupling portions which laterally bridge the connecting legs and the second connecting legs along the top plate inner surface, supports the second vibrating thin plates in a state where the second vibrating thin plates are loosely inserted into the through holes, and is connected to the top plate inner surface at least two points.

4. The stringed instrument according to claim 2, wherein the brace bar further comprises a bridge coupling leg which is provided vertically from the horizontal coupling portion, and connected to the top plate inner surface at a position opposed to the attachment position of the bridge attached to the top plate outer surface.

5. The stringed instrument according to claim 1, comprising a brace bar which has a bar base provided on the top plate inner surface at a position opposed to the bridge and a long bar vibration portion extended in the direction orthogonal to the longitudinal direction of the bridge from the bar base, the brace bar being formed into a T-shape or an L-shape, and sound posts which are arranged vertically from distal ends of the long bar vibrating portion, and distal ends of which are abutted against one of the vibrating thin plates of the cone vibration adjusting portions and the raised areas of the trench vibration adjusting portions provided on the back plate inner surface.

6. A stringed instrument comprising, a body formed into a hollow state, which has a top plate, side plates, a back plate and vibration adjusting means provided on at least one of the top plate and the back plate, wherein the vibration adjusting means of the body comprises an internal vibration plate which is arranged along the longitudinal direction of a bridge attached to a top plate outer surface at a position of a top plate inner surface so as to be opposed to the bridge, bridges side plate inner surfaces of a pair of the side plates opposed to each other, and divides a hollow space inside the body into at least two parts.

7. The stringed instrument according to claim 6, wherein the hollow space has:

a first resonation space which is positioned at an upper portion of the bridge, and communicates with the outside through a sound hole bored through the top plate; and a second resonation space which is positioned at a lower portion of the bridge, and is divided from the first resonation space by the internal vibration plate, and the top plate has a second sound hole which is bored through the plate and communicates with the second resonation space.

8. The stringed instrument according to claim 6, further comprising;

a supporting portion which is attached to the top plate inner surface in the vicinity of the internal vibration plate; and a vibration bar which is arranged vertically from the supporting portion and connected to a part of the plate surface of the internal vibration plate at the distal ends of the vibration bar.

* * * * *